US005599061A

United States Patent [19]

Curtius

[11] Patent Number: 5,599,061

[45] Date of Patent: Feb. 4, 1997

[54] SEAT FOR SITTING IN THE MIDDLE POSITION

[76] Inventor: Fritz Curtius, Schachenerstrasse 72, W-8990 Lindau, Germany

[21] Appl. No.: 439,760

[22] Filed: May 12, 1995

Related U.S. Application Data

[63] Continuation of Ser. No. 55,693, Apr. 20, 1993, abandoned.

[51] Int. Cl.[6] ..... A47C 3/02

[52] U.S. Cl. ..... 297/270.5; 297/326; 297/337

[58] Field of Search ..... 297/344.19, 302, 297/303, 313, 326, 4, 316, 302.1, 302.5, 303.1, 258.1, 270.1, 270.5, 337

[56] References Cited

U.S. PATENT DOCUMENTS

| | | | |
|---|---|---|---|
| 1,358,640 | 11/1920 | Koyama | 297/303 X |
| 1,437,848 | 12/1922 | Kisor et al. | 297/326 |
| 2,280,732 | 4/1942 | Thum . | |
| 2,311,384 | 2/1943 | Harpstrite | 297/303 X |
| 2,631,652 | 3/1953 | Bannister | 297/4 |
| 3,014,686 | 12/1961 | Golden et al. | 297/303 X |
| 3,306,658 | 2/1967 | Roberts | 297/4 |
| 3,784,148 | 1/1974 | Hill . | |
| 3,891,270 | 6/1975 | Crossman et al. | 297/334.19 |
| 4,236,752 | 12/1980 | Mizelle | 297/303 |
| 4,411,468 | 10/1983 | Apissomian . | |
| 4,451,080 | 5/1984 | Nix | 297/4 |
| 4,534,591 | 8/1985 | Parker | 297/270.5 |
| 4,544,200 | 10/1985 | Dunn et al. . | |
| 4,653,808 | 3/1987 | Opsvile | 297/41 X |
| 4,738,487 | 4/1988 | Shalinsky et al. . | |
| 5,048,893 | 9/1991 | Cowan et al. . | |

FOREIGN PATENT DOCUMENTS

| | | |
|---|---|---|
| WO8504084 | 9/1985 | France . |
| 2569965 | 3/1986 | France . |
| 1812360 | 6/1960 | Germany . |
| 1429332 | 11/1968 | Germany . |
| 7245423 | 9/1973 | Germany . |
| 2314717 | 10/1974 | Germany . |
| 3519673 | 12/1986 | Germany . |
| 3421550 | 8/1987 | Germany . |
| 3902694 | 8/1990 | Germany . |
| 9012189 | 12/1990 | Germany . |
| 3921384 | 2/1991 | Germany . |
| 1676622 | 9/1991 | U.S.S.R. . |
| 2198936 | 6/1988 | United Kingdom . |
| 2230696 | 10/1990 | United Kingdom . |
| WO9008490 | 8/1990 | WIPO . |

OTHER PUBLICATIONS

Stokke, leaflet showing various seats for sitting in a kneeling position of the type described in the subject application. Obtained at a furniture exhibit in Cologne, Germany, Oct. 1992.

*Primary Examiner*—Milton Nelson, Jr.
*Attorney, Agent, or Firm*—Spencer & Frank

[57] ABSTRACT

A chair includes a seating part having a forward direction in which an occupant of the chair faces when normally seated on the seating part. The seating part has a forward portion for horizontally supporting the thighs of the occupant. There are further provided a support structure secured to the seating part and extending downwardly therefrom; and a pivot axle formed of a bar secured to a lower part of the support structure. The pivot axle extends transversely to the forward direction and forms, by contact with a floor, a pivotal arrangement for providing a forward and a rearward swinging motion of the seating part and the support structure about a pivot axis situated below the seating part. The seating part and the support structure are free from a structural resetting arrangement, whereby the seating part and the support structure are exposed to pivotal forces derived solely from forces applied to the occupant's body.

5 Claims, 1 Drawing Sheet

SEAT FOR SITTING IN THE MIDDLE POSITION

This application is a continuation of application Ser. No. 08/055,693, filed Apr. 20, 1993, now abandoned.

BACKGROUND OF THE INVENTION

The invention relates to a chair for achieving a central sitting position and for retaining this sitting position by means of a movement of the seating surface. The movement is generated by the movement mechanisms of the human body and effects active sitting. The invention is suitable for carrying out professional and private tasks, even over relatively long periods of time.

One of the common illnesses, which can be caused by the wrong distribution of loads when sitting are back problems. In "Der Spiegel", no. 23, 45th year, pages 214–235 of 3 Jun. 1991, back pains are reported as being the people's illness.

The cause of this is described as a general lack of movement and sitting still for long periods of time when working. As a medical step towards reducing the back problems, "back schools" were set up by the German Society for Orthopedics and Traumatology. One of the aims of these back schools is to help the individual to find his/her own pain-free central position of the spinal column.

The general issues in conjunction with back pains are described in "Bandscheiben-schäden" [slipped disks], TRIAS-Thieme Verlag, Stuttgart/1988 by P. Oldenkott.

The present invention relates to a chair which facilitates finding the pain-free central position when sitting and which avoids the disadvantages of the damaging, static sitting position by conscious or even unconscious movements.

One method of finding a central position when sitting is a sitting position on the knees. In this arrangement, the weight of the body rests on an oblique support for the bent knees and a further support for the pelvis. The central position, favorable for the spinal column, of the upper body is found by balancing the upper body forward and backward. This type of balancing has the disadvantage for the back that each active movement of the upper body is triggered by tensing the ligamentous apparatus in the back and, as a result, the compressive forces within the spinal column are even increased.

Chairs with knee support have generally these disadvantages:

- each compensating movement in the lumbar vertebral region manifest itself as a swinging movement of the extended spine and, in the region of the head, manifests itself as swaying movement;
- a lengthy period of rest in the central position may also be the cause for a pain in the region of the lumbar vertebrae;
- with each actual relaxing movement in the region of the central position, the moment and thus the compressive forces on the corresponding vertebrae are increased;
- a knee or the bent lower leg are not capable of transmitting exterior forces indefinitely.

Despite the central position, after sitting for a relatively long period of time in accordance with this sitting method, a pain is thus generated which can lead to further tension in the back.

SUMMARY OF THE INVENTION

The object of the invention is to avoid the disadvantages of the outlined sitting method and, at the same time, to permit movement of the vertebrae in the region of the lumbar vertebrae which is at risk while sitting for a relatively long period of time.

This object is achieved by a chair according to the invention. The chair includes a seating part having a forward direction in which an occupant of the chair faces when normally seated on the seating part. The seating part has a forward portion for horizontally supporting the thighs of the occupant. There is further provided a support structure secured to the seating part and extending downwardly therefrom; and a pivot axle formed of a bar secured to a lower part of the support structure. The pivot axle extends transversely to the forward direction and forms, by contact with a floor, a pivotal arrangement for providing a forward and a rearward swinging motion of the seating part and the support structure about a pivot axis situated below the seating part. The seating part and the support structure are free from a structural resetting arrangement, whereby the seating part and the support structure are exposed to pivotal forces derived solely from forces applied to the occupant's body.

- the sitting position is undertaken on a moveable seating surface;
- the seating surface and thus the body on the seating surface can be displaced horizontally out of the rest position by slight bending or stretching of the legs out of the sitting position selected;
- and, in this arrangement, the seating surface moves on a line which has the respective central point of curvature beneath the seating surface.

The conventional rocking chair permits a known method of sitting on a seating surface moved by the seated occupant. Every movement of the chair also involves a horizontal movement of the seating part. The characteristic feature of the rocking movement is, however, a rolling movement on a curve which has the central point of curvature above the seating surface. This means that the pivot axis is located above the seating part.

On the contrary, the movement according to the invention is a horizontal movement or a tipping movement backwards or forwards.

In accordance with the findings of the back schools, lateral movements of the upper body are to be avoided in particular and, for example, certain movements forwards and to the side are separated into two movement phases: pivoting of the bearing surface and a subsequent bending of the upper body.

Correspondingly, the seating part according to the invention is laterally a stable and can only move forwards and backwards. That is to say, the seating part can tip forwards or backwards about an axis beneath the seating part.

The pivoting of the seating part is described in conjunction with FIG. 3.

Due to the possibility of being able to move forwards or backwards, the seating part is not in a stable position without uniform loading, i.e. without a sitting person. In the hypothetical case in which a vertical, uniformly distributed force acts on the seating surface and the resultant of this force runs through the central point of the pivot spindle (axle) of the seating surface, then this state is stable according to the laws of mechanics. This state is stable because, on each pivoting movement of the seating surface, a part of the loaded surface also moves upwards. This upwards movement is counteracted by the exterior force.

When the load of the sitting person in the central position acts on the seating surface, the vertical force is generated by the weight of the body. The legs rest neutrally on the floor and permit a horizontal introduction of force onto the seating part, in order to retain the seating part in the correct position beneath the upper body and above the pivot point. The resultant force of the body runs in this case too, through the central point of the pivot spindle.

In accordance with the method of sitting according to the invention, it is thus possible to displace the position of the seating part beneath the body with a small horizontal force. The forces for producing the movement are generated by the large and insensitive muscles of the feet and legs and are transmitted via the large amount of leverage given by the legs. The horizontal movement also permits a correct movement of the respective lumbar vertebrae, while the head and the shoulder girdle remain at rest in the central position.

In comparison, changing the sitting position on a rigid seating part has the disadvantage that the different forces have to be generated by other sensitive muscles and ligaments and have to be transmitted via the small leverage given by the loaded dorsal vertebrae. In this arrangement, the lumbar vertebrae only change their position to a small extent.

DESCRIPTION OF THE PREFERRED EMBODIMENTS

In the following, the chair and the associated function of sitting are described with reference to FIG. 1.

Figure 1:
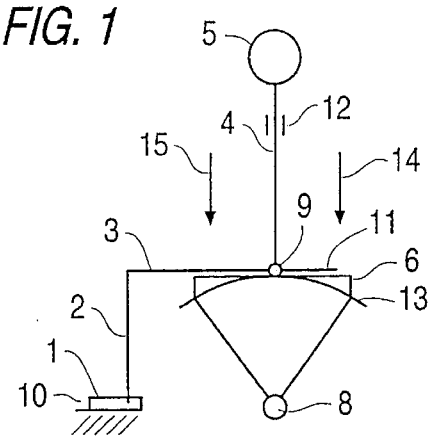
FIGS. 1, 2, 2*a* and 3 are schematic side elevational views of three preferred embodiments of the invention.

A lateral view of the sitting position and the forces acting in this arrangement are shown in FIG. 1. The seating part 6 is supported on two reinforcing members 7 and is mounted for pivotal motion in the pivot point 8. The sitting person has the feet 1, the lower legs 2, thighs 3, spine 4 and head 5. The feet 1 rest on the floor 10 and permit horizontal forces to be transmitted onto the seating part 6. The connection between the spine 4 and the thigh 3 is shown as articulation 9. The force transmission onto the seating surface is effected over surfaces via a part of the thigh 3 and of the pelvis, which is shown as the horizontal extension 11 of the thigh 3. The thighs 3 extend substantially horizontally and are supported horizontally by the seating part 6.

The spine is shown in conjunction with a lateral guide 12. Only a horizontal auxiliary force, a torque about the point 8, can be absorbed in this guide. The weight actually rests on the feet 1 and the pivot spindle 8. The lower legs 2 and the thighs 3 act as transmission levers. In the central position, the horizontal forces acting on the guide 12 are equal to "0". The articulation 9 is actually formed by the five lumbar vertebrae which permit a deflection and movement in the horizontal direction of the seating part beneath the upper body.

This horizontal deflection permits the searching for the central position and a constant movement of the pressure stressed lumbar vertebrae.

In the following, a description is given of the effect of the deflection and of the exterior forces occurring in the process.

Upon a forwards movement in the direction of the feet, the rear part of the seating part moves upwards in parallel (in congruence) with the circle arc 13.

In the region of the pelvis (indicated by the horizontal extension 11) which rolls on the seating surface, a relatively large pressure on the seating surface is generated that is, more body weight is transmitted onto the seating surface here. The resultant force 14 thus no longer runs in the center through the pivot point 8, but to the right of the center. This force forms a stabilizing torque about the pivot point 8 in order to restore the seating part 6 into the original position.

The effect of the above discussed forward movement on the five lumbar vertebrae is like stretching. When sitting normally, on the other hand, the spinal column is bent and an extreme pressure acts upon the front sides of the vertebrae and the intervertebral disks. Partial stretching of the vertebrae out of this sitting position relaxes the spinal column. This feels pleasant.

In this phase of forwards movement and stretching of the lumbar vertebrae, the spine is increasingly supported by the strong and insensitive stomach muscles—which also feels pleasant.

Upon backward movement of the seating part, the front part of the seating surface moves upward.

In the region of the thigh 3, a relatively large force is applied to the seating surface that is, more body weight is transmitted onto the seating surface here. The resultant force 15 thus no longer runs in the center through the pivot point 8, but to the left of the center. This force forms a stabilizing torque about the pivot point to the left in order to restore the seating part 6 into the original position.

According to the laws of mechanics, the proposed method of sitting is thus also stable in case of a backward movement.

The effect of the above backward movement on the five lumbar vertebrae is like bending—this feeling is less pleasant. As a result of the possibility of being able to recognize the differences easily, the optimum sitting position can be searched for namely a mid position between the pleasant movement direction and the unhealthy unpleasant moment.

Thus, as described, the chair of FIG. 1 is maintained in equilibrium solely by the forces applied thereto by the occupant.

The chair and the associated sitting technique, as described in FIG. 1, thus provides the following advantageous features:

when sitting, the lumbar vertebrae are moved into a relaxed position, the upper body and the head can be held at rest and the initiating force for the movement is generated and transmitted by the large and insensitive muscles of the legs.

In the region of the intervertebral disks of the lumbar vertebrae, it is possible to first mobilize the individual vertebrae. It is possible to bend the spinal column alternately in both directions, forwards and backwards. As a result, the loads acting between the vertebrae and the intervertebral disks are displaced from the front side to the rear side, and conversely.

A pulsating load acts upon the spinal column.

Experience further shows that, when sitting, a normal forward bending movement, which generates considerable loads in the spinal column but is often not directly perceived, can be left on the novel chair, in the legs as an additional, large torque and strong pressure and can thus easily be compensated.

The function of the chair and the body motions form a functional unit which permits active sitting.

Figure 2:
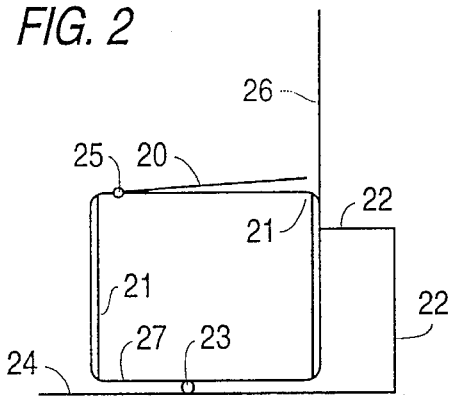

FIG. 2 shows the side view of a chair or stool (without rest 26) supporting structure, of another embodiment. As the chair or stool has in each case two tubular frames 21 to the left and right of the seating part 20. The seating surface (not shown) is rectangular.

The supporting structure rests on the pivot spindle 23 which bears, for example, on an underlying surface, such as the floor 24. This pivot spindle 23 can be configured as a bar having a circular, semicircular or angular cross-section. It has been proved that a bar having a diameter of 10–20 mm permits a pleasant movement of the seating surface.

The bar can be fixedly connected to the chair or can rest loosely on the floor or even under a covering (e.g. carpet or rubber mat). The bar or the pivot spindle can also be a constituent part of a foundation structure or an articulation (not shown).

In known office chairs, it is possible to adapt the angle of the seating surface to personal requirements. In the central position, the seating surface is set with a slight forwards inclination. This possibility is shown in FIG. 2 by the pivot point 25.

In general, relaxing when sitting for a relatively long period of time is effected by leaning back on a back rest. With the new method of sitting, the relaxing "curving of the spinal column backwards" in the region of the lumbar vertebrae is achieved by a forward movement of the seating part. The movement therefore is opposite to the hitherto conventional movement. In this arrangement, contact with the back rest 26 may also occur, particularly, with the upper edge thereof. In this arrangement, the pleasantly relaxing "curving of the spinal column" is increased.

When sitting on a stool according to FIG. 2, the risk of tumbling backwards did not occur over months of test since the occupier of the seat easily and rapidly becomes accustomed to the simple movement.

However, it may be advisable to design a chair, as shown in FIG. 2, with a back rest 26 and a means 22, having a stop to prevent tipping.

In conjunction with FIGS. 1 and 2, an apparatus has been described in which the possibility of movement of the seating surface is based on the support in an articulation or the support of the non-loaded chair in a state of neutral equilibrium.

In case of pivoting chairs or where space is constricted, as is the case in passenger cars or airplanes, this mounting is not always possible. According to a further feature of the invention, the seating surface can be movably mounted on a curve or straight line as the bearing means, permitting a comparable movement of the seating part.

Figure 3:
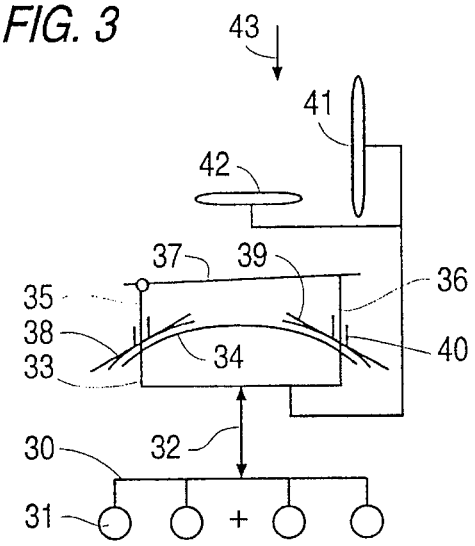

This method of mounting is shown in FIG. 3 and is described below.

The moveable seating part 37 rests on a chair foot 30 with the castors 31. Vertical adjustment is effected via the vertical supporting (bracing) means 32 on which the frame 33 is mounted so as to be vertically adjustable and optionally pivotable. The circular sliding curve 34, on which the seating part is guided when it moves, is fastened on the frame 33. The seating part 37 rests on the bracing means 35 and 36 as parts of the supporting structure. The inclination of the seating part indicates that the angle of the seating part can be adjusted, as shown in FIG. 2.

According to the invention, the seating part and the person sitting thereon can slide forwards and backwards along the curve 34 upon movement of the seating part. In the normal central sitting position, the amplitude of this movement is approximately 5 cm. The entire circular curve 34 is thus not required as a bearing for the seating part, but only corresponding bearing means 40 beneath the bracing means 35 and 36. These relatively short curves 38 and 39 are drawn here as the tangents to the circular curve 34. The inclination of the curves 38 and 39 and the type of curve, e.g. circle arc, ellipse, parabola etc., can be varied according to the movement characteristic desired. However, with configuration as a horizontal sliding curve, it is advisable to provide a restoring possibility, e.g. in the form of a spring, for the sitting movement.

The drawing further shows a backrest 41 and the corresponding armrests 42. The backrest 41 and the armrests 42 are firmly connected to the frame 33. Since the amount of force used to move the seating part with the legs is generally smaller than the sliding forces required to move the castor-operated/pivoting chair, the chair can be displaced via the body contact with the fixed rests.

When installing a moveable seat in a passenger car, good contact between the back and the backrest is important. Good contact with the backrest 41 is ensured by a sitting position behind the normal central position, i.e. the resultant supporting (body) force 43 runs between the pivot axis of the seating part and of the backrest.

In the case of a corresponding load, the seat has a tendency to move backwards and presses the back of the occupant against the cushioning which can be shaped with health consideration in mind.

This method of sitting is particularly advantageous when carrying out professional tasks which require force transmission with the arms (such as conveyor-line assemblies or mechanical machining of workpieces).

Use of the chair is thus advisable for any tasks which involve sitting: for physically demanding work; for light and sedentary tasks; and for working at computer terminals and housework.

In correspondence with the body motions, the chair provides the sitting person with a sitting technique which effects active sitting (no passive resting).

Since the chair and the body motions form a functional unit, a sequence of functions for the sitting process can be described as follows:

prior to and during sitting down—the statically non-fixed seating part is held by an exterior force or by the hand of the person in the process of sitting down;

from the commencement of sitting—the seating part is brought into the statically determined central position by the contact via the pelvis and the movement of the legs (bending/stretching), and the body weight is absorbed by the pivot spindle or the guide rail(s) and by the feet of the sitting person;

when standing up—the seating part which is no longer statically secured is held by an exterior force, e.g. by the hand or a supporting means.

Example for a chair according to FIG. 2

| | |
|---|---|
| lateral length of the frame 21 | 47 cm |
| diameter of the pivot spindle 23 | 1.6 cm |
| seat height | 46 cm |
| amplitude | 5 cm |

type of seating part: flat metal shell (such as that used in a combine harvester or a tractor) provided with cushion.

If the chair according to FIG. 2 is mounted on a plate 27 which is thicker than 1.6 cm, instead of on the pivot spindle 23, then the same sitting comfort is achieved. For this purpose, the plate extends to the right from the pivot spindle 23 to the means 22 for preventing tipping. This construction permits static sitting on a seating part safeguarded against tipping and active sitting in the central position by the forward movement of the seating part.

Figure 2A:
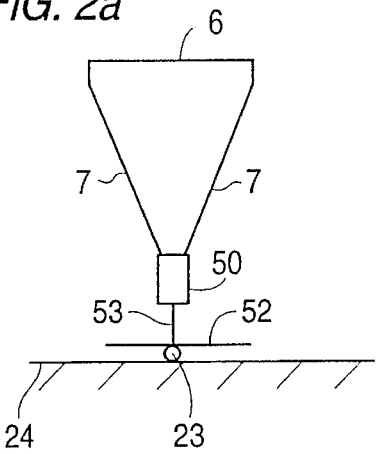

In the chair according to FIG. 2*a*, by exchanging the frame 21 of the supporting structure for a gas pressure spring or a telescopic support 50, the height of the seating part 6 can be designed so as to be adjustable. This adjustable support is mounted above the pivot spindle 23. The pivot spindle is designed, for example, as a semicircular profile having a diameter of 3–6 cm. The necessary strength and the means for preventing the chair from tipping over are achieved by fitting a rigid plate 52 between the pivot spindle and the vertical support 53.

Figure 2B:
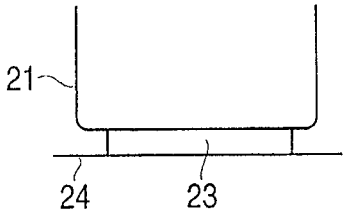
FIGS. 2*b* and 2*c* are schematic fragmentary front elevational views showing two variants of the invention.
Figure 2C:
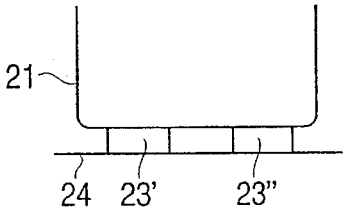

As seen in the front elevation view of FIG. 2*b*, the pivot spindle 23 is a continuation bar, whereas in the variant shown in FIG. 2*c*, the pivot spindle is formed of bar portions 23' and 23".

I claim:

1. A chair comprising (a) a seating part having a forward direction in which an occupant of the chair faces when normally seated on the seating part; said seating part having a forward portion for horizontally supporting thighs of the occupant;

(b) a supporting structure secured to said seating part and extending downwardly therefrom;

(c) a pivot spindle formed of a bar secured to a lower part of said supporting structure; said supporting structure being supported on said pivot spindle; said pivot spindle having a circumferential rolling surface being in a linear rolling contact with a floor in a direction extending transversely to said forward direction for providing a forward and backward swinging motion of said seating part and said support structure about said linear rolling contact;

(d) adjusting means for varying a height position of said seating part relative to the floor such that the occupant's thighs extend substantially horizontally, the occupant's lower legs extend substantially vertically and the occupant's feet are planted on the floor; said seating part and said support structure being free from resetting means, whereby said seating part and said support structure are exposed to pivotal forces derived solely from forces applied by the occupant's body; and (e) means situated rearwardly of said pivot spindle for limiting a rearward tilting of the chair to prevent a rearward overturning thereof.

2. The chair as defined in claim 1, wherein said spindle has a diameter of less than 6 cm.

3. The chair as defined in claim 1, wherein said spindle has a diameter of between 3 and 6 cm.

4. The chair as defined in claim 1, wherein said bar is continuous.

5. The chair as defined in claim 1, wherein said bar is formed of bar portions.

* * * * *